United States Patent [19]

Briggs

[11] 4,204,358

[45] May 27, 1980

[54] ALUMINUM MODEL AIRPLANE KIT

[76] Inventor: Donald L. Briggs, 1703 Hauser Blvd., Helena, Mont. 59601

[21] Appl. No.: 886,123

[22] Filed: Mar. 13, 1978

[51] Int. Cl.[2] ..... A63H 27/02

[52] U.S. Cl. ..... 46/76 R; 29/469.5; 244/123; 244/133

[58] Field of Search ..... 46/76 R, 79, 80, 81; 29/455 LN, 469.5, 407; 244/123, 124, 133

[56] References Cited

U.S. PATENT DOCUMENTS

| | | | |
|---|---|---|---|
| 1,790,849 | 2/1931 | Tegarty | 46/79 |
| 1,854,330 | 4/1932 | Delage | 244/124 |
| 2,143,541 | 1/1939 | Caprine | 46/76 R |
| 2,396,886 | 3/1946 | Rossiter | 46/76 R |
| 2,397,364 | 3/1946 | Myers | 46/76 R |
| 3,388,651 | 6/1968 | Axelrod | 46/76 R |
| 3,640,492 | 2/1972 | Star | 244/124 |
| 4,032,089 | 6/1977 | Kinzler et al. | 244/123 |

FOREIGN PATENT DOCUMENTS

| | | | |
|---|---|---|---|
| 210784 | 10/1924 | United Kingdom | 244/133 |

*Primary Examiner*—John F. Pitrelli
*Attorney, Agent, or Firm*—Wendell Coffee

[57] ABSTRACT

A motorized model vehicle is formed of sheets of aluminum attached by heat soluble glue. The model has no internal supporting structure, but relies upon the resilient prestress of the metal sheet to maintain a desired shape. Methods of folding, forming, connecting and strengthening the parts of the aluminum body are disclosed.

6 Claims, 16 Drawing Figures

Fig. 1
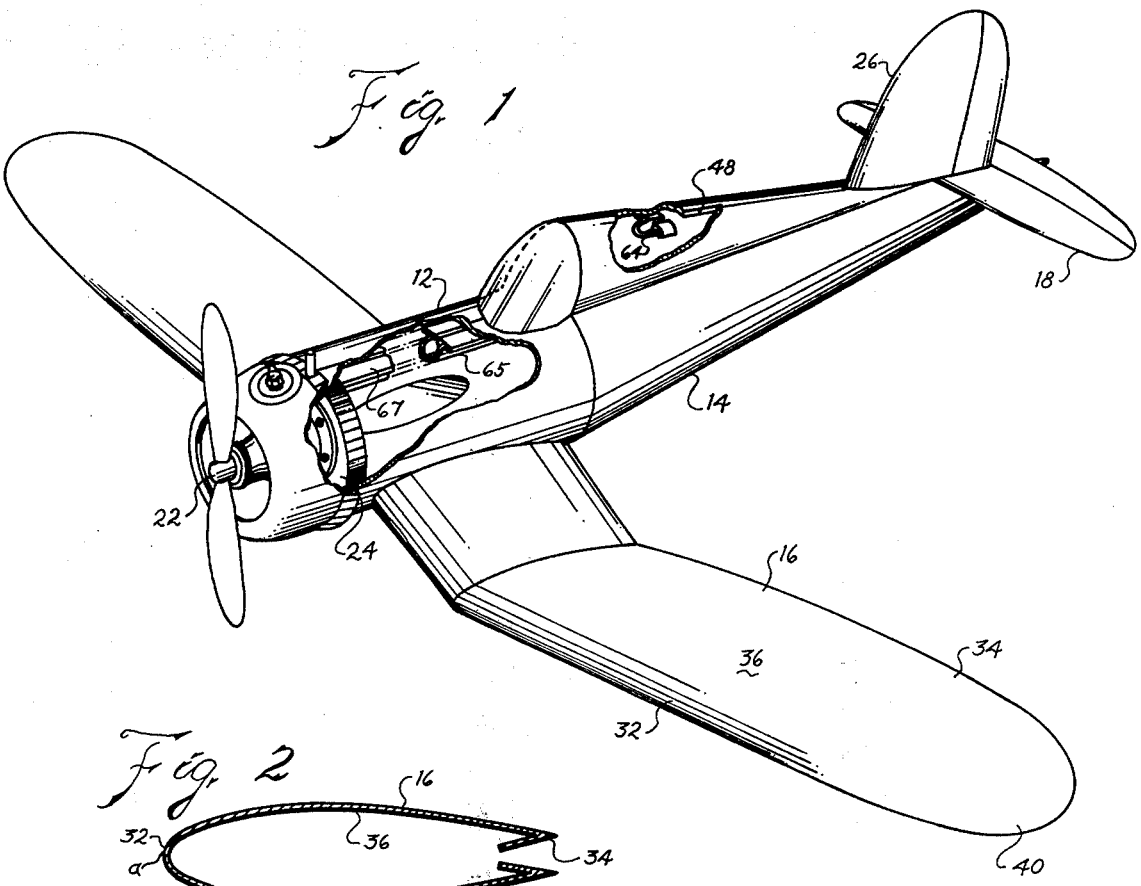
Fig. 2
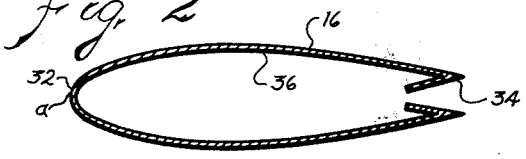
Fig. 4
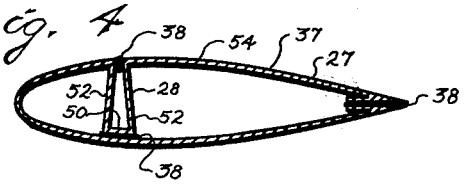
Fig. 6
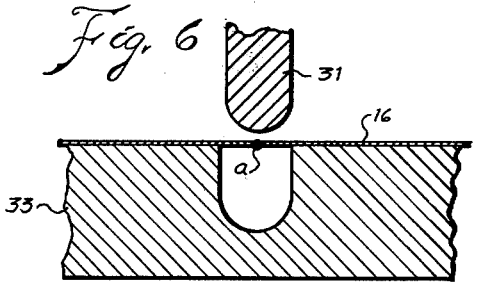
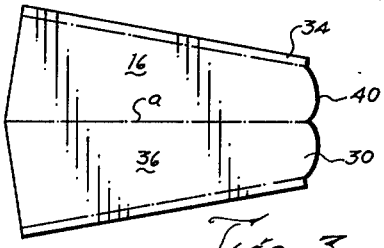
Fig. 3
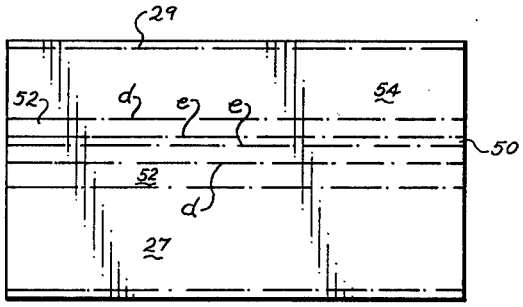
Fig. 5

ALUMINUM MODEL AIRPLANE KIT

BACKGROUND OF THE INVENTION (1) Field of the Invention

This invention relates to model vehicles and to kits for building model vehicles, particularly model airplanes.

(2) Description of the Prior Art

Model vehicles and especially model airplanes are of two types. The first type is constructed of balsa wood or other light wood. Many structural supports are provided, with the balsa being covered by fabric or other lightweight covering.

The second type is a molded, plastic shell joined with styrene glue, etc., to form a rigid frame which may be easily assembled and joined together.

However, even with the use of balsa wood and plastic, such model airplanes or model vehicles are still relatively heavy. The use of balsa and/or plastic requires a great deal of time to assemble and are relatively fragile. Balsa and plastic are relatively fragile, and damaged parts must ordinarily be replaced with new ones instead of repairing the old. Such models also tend to shatter upon impact with solid objects, and to be unusable until repaired.

Before this application was filed, an independent search was made which produced the following references. None of them seemed particularly pertinent to the applicant.

| | |
|---|---|
| Babcock | 2,555,670 |
| Bergstrand | 2,870,569 |
| Bergstrand | 2,917,865 |
| Lindberg | 2,920,682 |
| Harrison | 3,273,281 |
| Purdy | 3,585,753 |
| DeWitt, Jr. | 3,594,946 |
| Conover | 3,633,306 |
| Harrison | 3,640,491 |
| Sigafoose | 3,963,554 |

SUMMARY OF THE INVENTION (1) New and Different Function

As noted above, previous motorized model vehicles were relatively heavy in order to provide the necessary structural rigidity and strength. I have solved this problem by employing aluminum sheets folded, formed and connected such that each sheet is under resilient prestress.

In the prior art, one reason for the greater weight in such models is an inner-supporting structure is required or the plastic must be of sufficient dimensional thickness to provide the necessary rigidity. By employing aluminum, great savings in weight are possible because the aluminum sheets under stress require no internal supporting structural members.

The resilient pre-stress may be illustrated by examining a wing of a model airplane. On a balsa model the formation of a wing requires ribs, struts and braces within the wing with an outer covering therearound. A plastic model requires plastic of sufficient thickness to provide the necessary strength and rigidity. This is illustrated well by the references previously cited, which show complicated and extensive inner-supporting structure.

My invention eliminates the need for any internal supporting structure by employing resilient pre-stress to maintain structural rigidity. By resilient pre-stress I mean that stress placed upon the sheet aluminum when the ends of the sheet are connected together, to form at least two halves with the sheets aluminum springably biasing the two edges apart. When the edges are rigidly connected, the two sides of metal resists deformation together, obviating the need for internal braces, struts, etc..

I employ heat soluble glue to attach the metal parts together inasmuch as this is the glue which best withstands the stresses placed upon the metal sheets and the contact of oil and fuel associated with the operation of such models.

The use of such heat soluble glue also simplifies assembly and replacement of damaged portions of the plane. The glue normally used with plastic models and with balsa wood models permeates the plastic or balsa, thereby making portions of such models relatively irreplaceably without further damaging them. However, portions of my model may be removed and replaced simply by reheating the heat sensitive glue, detaching a damaged part, and replacing it with a new one, or, simply straightening or reforming the damaged part and replacing it.

Therefore, I have invented a model vehicle and especially a model airplane, which is significantly lighter, more easily repaired, more easily assembled and with superior structural strength. The kit for assembling such a model is greatly simplified, more compact, and facilitates the assembly of such a model. It should, therefore, be apparent that the model airplane and the kit of my invention have a total function greater than the sum of the functions of the individual parts, e.g., sheet aluminum, glue, jigs, and motors.

(2) Objects of this Invention

An object of this invention is to provide an improved model vehicle, especially an improved model airplane.

Another object of this invention is to provide a kit which may be easily assembled to form such a model.

Further objects are to achieve the above with a device that is sturdy, compact, durable, lightweight, simple, safe, efficient, versatile, ecologically compatible, energy conserving, and reliable, yet inexpensive and easy to manufacture, assemble, adjust, operate and maintain.

Other objects are to achieve the above with a method that is versatile, ecologically compatible, energy conserving, rapid, efficient, and inexpensive, and does not require highly skilled people to assemble, adjust, operate, and maintain.

The specific nature of the invention, as well as other objects, uses, and advantages thereof, will clearly appear from the following description and from the accompanying drawing, the different views of which are not scale drawings.

BRIEF DESCRIPTION OF THE DRAWING

FIG. 1 is a perspective view of a mode airplane embodying my invention with parts broken away for clarity.

FIG. 2 is a cross-sectional schematic view of a wing in the process of being formed.

FIG. 3 is a plan view of the pattern of the wing shown above with folding lines indicated thereon.

FIG. 4 is a cross-section of a modified wing having a spar fold.

FIG. 5 is a pattern for the modified wing of FIG. 4.

FIG. 6 is a sectional view of a jib for forming the leading edge of the wing with the wing shown thereon in cross-section, somewhat schematical, with a dot at the marked center line of the wing.

DESCRIPTION OF THE PREFERRED EMBODIMENTS

Figure 7:
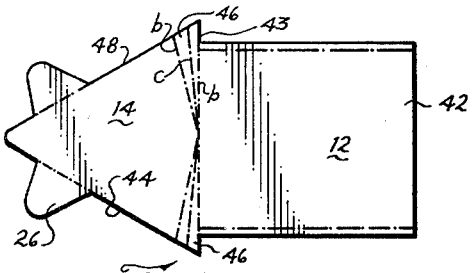
FIG. 7 is a plan view of a pattern for a "shape fold" fuselage with fold lines shown thereon.

Aluminum sheets having a thickness of approximately 10 mils (0.25 mm) form the members of a model airplane body. I have had good success with used photolithograph plates. I understand these plates to be rolled which results in desirable mechanical properties. As shown in the drawing, the body is hollow with no internal structure to support the aluminum sheets to maintain the desired shapes.

The members of the model plane may be briefly described as front fuselage 12, rear fuselage 14 and rudder 26 to which wings 16, stabilizers 18, landing struts, motor 22 and motor mount 24 are connected.

The only structure which may be considered as a supporting structure is located at the motor mount 24, shown in FIG. 1. An additional support spar 28 at the wing joint (FIG. 4) may be necessary in models having longer wing span. For smaller models the rigidity and strength provided by the aluminum construction is sufficient.

I accomplish this great rigidity and strength without the need for internal supporting by forming the aluminun in the desired shape with various folds and bends in the metal. Resilient pre-stress, which provides the rigidity and strength, may be understood upon examining the structure of the wing 16 as shown in FIG. 2. A section of sheet metal 10 is cut according to pattern 30 and fold lines transferred thereto from the pattern 30 (FIG. 3). Center fold line is represented by line "a" in FIG. 2, 3 and 6. The metal is folded and formed at the fold line "a" into the desired shape of leading edge 32. This may be done by simply folding the metal or by employing a jig, as illustrated in FIG. 6. Male portion 31 of the jig is fitted into female portion 33 of the jig with the fold line at the center thereof, and formed by pressing the sheet of aluminum between the two portions of the jig.

Upon completion of the folding at the fold line "a", trailing edges 34 of the wing are springably spaced apart, FIG. 2. It is important to note that only the leading edge 32 is formed using the jig, if such a jig is used. The two mid-sections of the sheet 10 between the leading and trailing edges are not formed. This insures that the trailing edges 34 are springably spaced apart.

Heat soluble glue 38 (shown with the modification in FIG. 4) is applied to the trailing edges 34 on the inside surfaces thereof. The two edges 34 are pressed together, the glue heated and allowed to cool, thereby connecting the two edges 34. Wing tip 40 is glued together from the leading edge to the trailing edge to seal the end of the wing.

It will be apparent that the two mid-sections 36 between the trailing edge 34 and the leading edge 32 thus forced together will be under stress which resists any force tending to press the mid-section 36 together. Thus, his resilient pre-stress obviates the need for any internal supporting structure inasmuch as the stress placed upon the aluminum will cause it to resist any inward deformation by outside forces such as wind, impact, etc. Therefore, to assemble the wing described, all that is needed is a section of a sheet of aluminum, a pattern 30 and heat soluble glue 38.

Thus, a wing may be formed by simply performing the folding and the gluing operations. This greatly simplifies assembly of the model as compared to the lengthy process of gluing balsa support struts, etc., together and covering them with fabric.

Should it ever be necessary to repair the wing 16, the seam at the trailing edges 34 may simply be reheated and the edges 34 separated. The damaged portion of the aluminum may be rolled or mashed and the sheet of aluminum refolded and glued to repair the wing.

Figure 8:
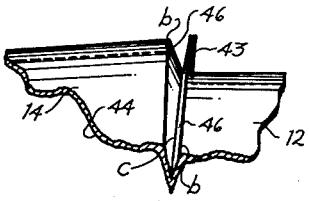
FIG. 8 is a perspective view of the folds in pattern of FIG. 6 in the process of formation.
Figure 9:
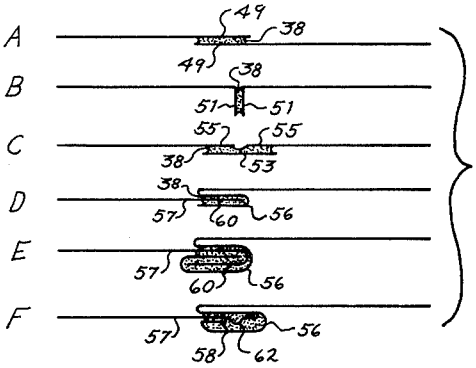
FIG. 9A–F is a schematic indication of a series of joints as may be used.

The rear fuselage 14 of the model plane shown in FIG. 1 may be assembled and greatly strengthened by employing a "shape fold" shown in FIGS. 7 and 8. The section of sheet metal is cut to the shape defined by pattern 42 and fold lines "b" and center line "c", respectively, transferred thereto. It will be noted the pattern has notch 43 therein. The area outside the fold lines "b" are outboard surfaces 44. The areas between the fold lines "b" and the center line "c" are inboard surfaces 46.

To form the rear fuselage 14, the sheet is folded in one direction at the fold lines "b", and in the opposite direction at the center line "c". Heat soluble glue is then applied to the inboard surfaces 46 and they are connected together. The fold is then folded against one of the outboard surfaces 44 and the fuselage curved and fuselage edges 48 glued together to form a tapering, hollow rear fuselage 14 with no internal supporting structure apart from the sheet aluminum.

The other various sections of th model plane may be similarly formed by employing the patterns appropriate the folding similar to that described. Many of these other folds are not shown inasmuch as they may vary greatly according to the model being assembled and the desired shapes.

However, some folds will be illustrated as well as methods of joining the edges of the sections of sheet metal to form such members. FIG. 4 is an alternative method of additionally strengthening the members of the model. A "spar fold" is illustrated for modified wing 27 inasmuch as other functions may apper from its use for that member. The wing 27 is formed as previously shown with the exception of two fold lines "d" and two center lines "e" transferred from the pattern 29 to the portion of the sheet metal which will be the upper surface of the wing 27. It will be understood however that such a spar fold could appear in almost any member. The area between the two center lines is inboard surface 50, the areas between the center "e" and the fold lines "d" are middle surfaces 52, and the areas outside the fold lines "d" are outboard surfaces 54.

To employ the spar fold, the fold lines "d" are folded in one direction and the center lines "e" are folded in an opposite direction, such that a trough or channel is formed in the mid-section 37. The fold lines "d" are then brought together and connected with heat soluble glue 38. The center surface 52 is connected with the heat soluble glue 38 to the inside surface of the sheet aluminum at the bottom mid-section 37 of the wing as shown in FIG. 4. This provides a connection of the sheet aluminum to points between the upper and lower mid-sections 37, much as an ordinary spar. However, the spar thus formed by the spar fold is formed out of the sheet, thereby requiring no other internal supporting structure. Similar spar folds may be employed for other members of the model, particularly for surfaces which are relatively close together.

It may be seen that the spar fold is a reinforcement which could be described as follows: the wing has two surfaces which are proximate one another. One of said surfaces being folded to form a convex depression therein as being the depression between the two surfaces 52. The bottom of the depression, or that surface 50, will be in contact with the other surface and then the bottom of the depression is glued to the other surface.

Employing the fold described, this especially rigid point in the wing or other model frame member is particularly appropriate from the location and the connection of controls for the model. Landing gear may also be placed therein inasmuch as the middle surfaces 52 form an excellent anchor point for such landing gear or other controls. Openings may also be left in the trailing edges 34 and connections of the sections to form the body to allow control wires and the like to be trained therethrough. Each of the members constructed from the section or sheets is connected with the heat soluble glue to another of the members, and when all of the members with the appropriate operating parts are connected together they form a model vehicle or for this embodiment a model airplane.

Figure 10:
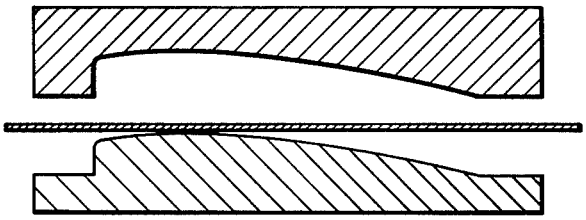
FIG. 10 is an illustration of a jig with the aluminum to be formed shown between the parts of the jig.
Figure 11:
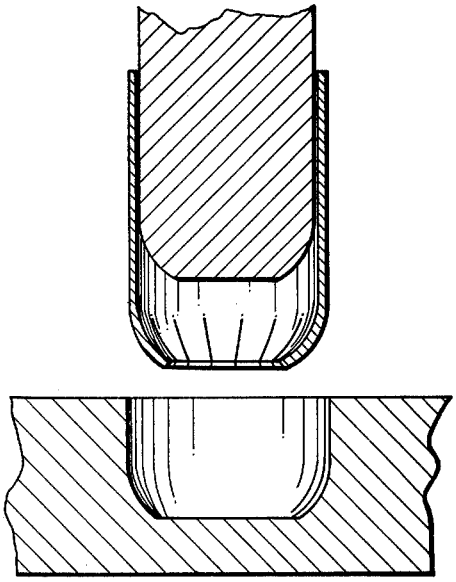
FIG. 11 is a sectional view of a jig for cylindrical parts.
Figure 14:
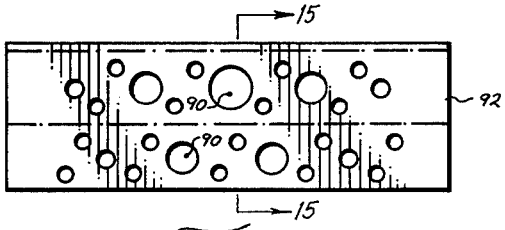
FIG. 14 is a plan view of scored piece of aluminum with perforations therein for a foil covered wing.

I find it convenient to hold portions of the members being assembled with clamps during the folding and shaping process to insure proper mating of edges and assembly. In addition, rivets or other small detail may be easily simulated by impressing an object having the desires shape into the sheet aluminum which deforms it at that point and leaves a permanent impression therein. An example of this would be employing a seamstress's tracing wheel having teeth thereon to make a line of points in the sheet metal, thereby simulating rivets. Other common tools may be employed to form the sheet metal, such as shown in FIG. 10 and FIG. 11 with the section of sheet metal being pressed between two jigs or a relatively hard object mashed against the sheet aluminum.

The motor mount 24 is a strip of aluminum formed in a circle and conforming substantially to the inside dimensions of the forward path of the front fuselage 12. The motor assembly 22 which includes the motor, fuel tank, and motor controls is secured using screws and bolts to the motor mount 24. The motor mount is glued inside the front fuselage 12 with heat soluble glue, thereby rigidly affixing the motor 22 in place.

I have invented several ways of joining the sheet metal edges together with joints A, B, C, D, and are illustrated in FIG. 8. A first way, joint A is simply to overlap the edges 49 and to place the heat soluble glue 38 at the overlap to secure the two edges 49 together. However, this is undesirable in that an ugly seam is formed. Joint B instead of overlapping, merely bends edges 51 to abut one another, with glue 38 connecting them.

Another joint C would be to place strip 53 at the intersection of the two edges when abutting each other and to secure the strip to each edge 55 with heat soluble glue 38. If it is desired to disassemble the model the heat soluble glue may simply be reheated and the pieces of the model withdrawn.

For joints of members for which the interior need not be exposable, the joints D, E and F of FIG. 8 may be employed. The joint D includes forming one of the edges 56 to substantially an S-shape and inserting the other edge 57 into pocket 60 formed by the S-shape. Heat soluble glue is then applied to secure the other edge 57 within the pocket 60.

The E joint is substantially identical with the exception that the other edge 57 within the pocket 60 and the other S-shaped edge 56 are both folded to form a hook such that when the other edge 57 is inserted into the pocket 60 the two hooks engage, thereby preventing any withdrawal of the other edge 57 from the pocket 60. Heat soluble glue may again be placed therein to rigidly secure the other edge 57 within the pocket 60.

The F joint is identical to the E joint with the exception that instead of a hook on the other edge 57, a series of dimples 62 are formed. The hook edge 58 of the pocket 60 engages the dimples 62, thereby retaining the other edge 57 within the pocket 60.

If it is desired to be able to reach the interior of the model, such as for replacing strings, pivots, pulleys and the like for operating the air foil surfaces of the plane, spring joint, illustrated in FIG. 1, may be employed to springably connect the two edges. The spring joint has loop 64 with tabs 66 which are secured to the inside surface of the sheet proximate the edges 48 such that the spring biases the edges 48 toward one another. Thus, if the interior of the member, in this example, the rear fuselage 14, need be reached, the two edges 48 are merely spread apart to expose the interior of the member.

Tube reinforcement joints are somewhat similar to the spring joint and are also illustrated in FIG. 1. In the tube reinforcement joint, the loop is extended so that it forms a tube 65. The tabs are likewise extended so they form flanges 67. This is shown connecting the joint of the front fuselage member 12. It may be seen that the tube 65 will form a structural reinforcement member at the joint giving additional strength at this point if desired. The tube 65 may be considered a channel in tubular form with two flanges.

Figure 12:
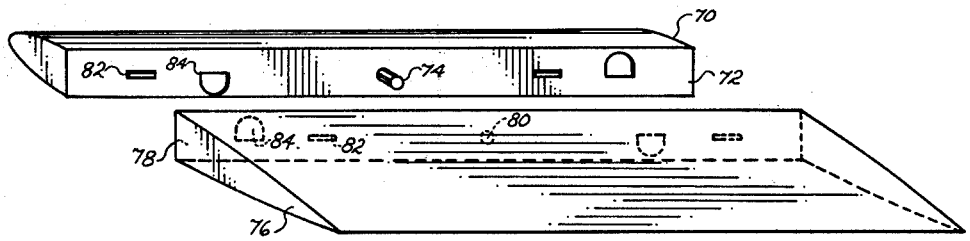
FIG. 12 is a perspective view showing the connection of a replaceable leading edge to a main wing section.
Figure 13:
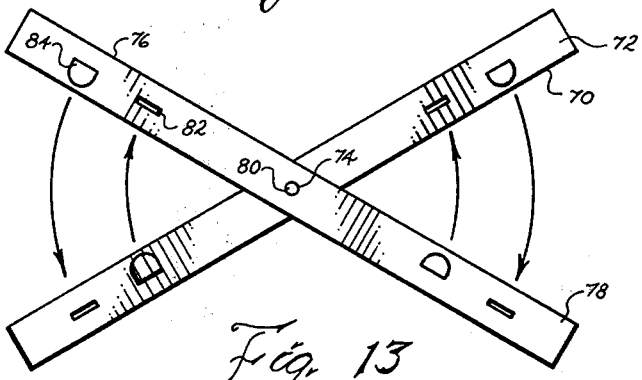
FIG. 13 is a schematic drawing representing the assembly of the leading edge to the main wing portion.
Figure 15:
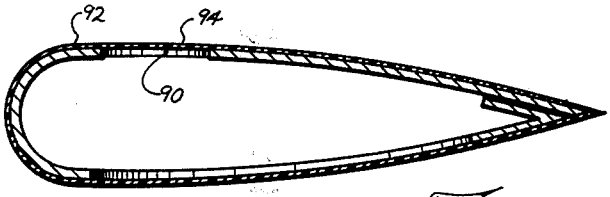
FIG. 15 is a cross-sectional view through a foil covered wing.
Figure 16:
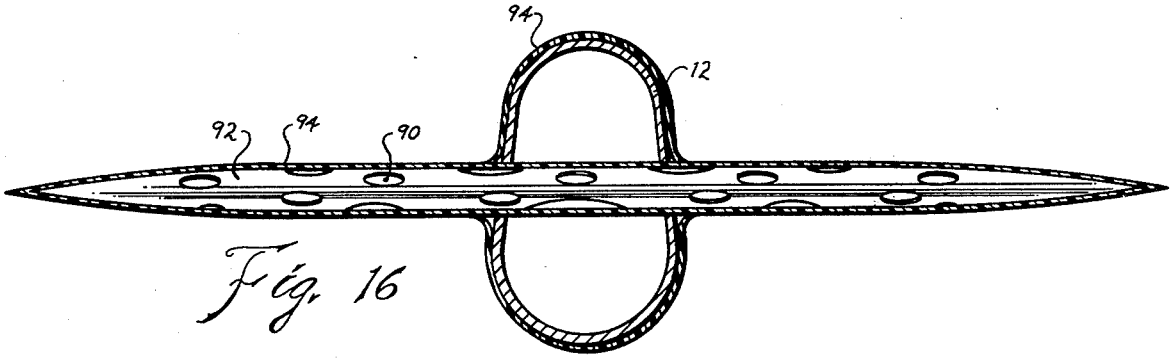
FIG. 16 is a sectional view through the fuselage and foil covered wing.

FIGS. 12 and 13 illustrate a replaceable leading edge of my invention. Leading edge 70 is formed as described previously from aluminum or may be solid material which is desired to be attached to the aluminum model. The leading edge 70 has face 72 thereon. Pin 74 protrudes from the center of the face 72. Aluminum trailing edge wing section 76 has a face 78 with hole 80 therein. The pin 72 engages the hole 80 to permit rotation of the leading edge 70 with respect to the trailing edge 76 about the hole 80 and pin 74. Both slots 82 and tabs 84 are opposite each other on each of the faces 72 and 78. The tabs 84 are oriented such that when the leading edge 70 is rotated in a given direction and the faces 72 and 78 brought into substantial alignment, the tabs 84 will engage the slots 82, thereby securing the leading edge 70 in a fixed position with respect to the trailing edge 76. This structure permits easy replacement of the leading edge 70 which may be frequently damaged upon landing, collisions, etc.

For special applications and special types of aircraft or other model vehciles, even the light aluminum structure previously described may be too heavy. Therefore, I have invented the following structure to produce an even lighter craft.

Openings 90 are cut in some of the members such as wings 92 at points at which the location of an opening 90 will not substantially affect the rigidity or strength of the aluminum sheets. This forms an aluminum framework without separate supporting members, apart from the aluminum framework.

Covering 94 in the form of a film such as aluminum foil or MYLAR is placed over the openings. I prefer to place the MYLAR or aluminum foil over the entire surface of the plane to give a finished look. Aluminum models constructed with this thin sheet of aluminum foil or MYLAR are substantially lighter without sacrificing strength or rigidity of the aluminum frame to which they are attached. Such an aluminum framework is itself lighter than balsa or plastic framework would be.

The patterns, jigs, glue and aluminum sheets described for producing the desired shapes and folds form a kit. This kit greatly facilitates the assembly of such models. In addition, such a kit will be substantially more compact and lighter in weight than other previous kits.

It will be understood that although the model described has been a particular kind, aircraft, my invention may be equally well employed with other types of models such as boats, cars, gliders, or any other motorized model vehicle. Therefore, it may be seen that I have invented a model vehicle which is lighter, stronger and more easily assembled and repaired than prior models. In addition, I have invented a kit which substantially facilitates assembling of such models.

As an aid to correlating the terms of the claims to the exemplary drawing, the following catalog of elements is provided:

| | | | |
|---|---|---|---|
| 12 | front fuselage | 49 | edges of sheet metal |
| 14 | rear fuselage | 50 | inboard surface, wing |
| 16 | wings | 51 | edges of metal |
| 18 | stabilizers | 52 | middle surfaces, wing |
| 22 | motor assembly | 53 | strip |
| 24 | motor mount | 54 | outboard surfaces, wing |
| 26 | rudder | 55–58 | edges of metal |
| 27 | modified wing | 60 | pocket |
| 28 | support spar | 62 | dimples |
| 29 | modified wing pattern | 64 | loop |
| 30 | pattern, wing | 65 | tube |
| 31 | male portion | 66 | tabs |
| 32 | wing leading edge | 67 | flanges |
| 33 | female portion | 70 | leading edge |
| 34 | wing trailing edges | 72 | face, leading edge |
| 36 | mid-sections of wing | 74 | pin |

-continued

| | | | |
|---|---|---|---|
| 37 | mid-section of modified | 76 | trailing edge |
| 38 | glue | 78 | face, trailing edge |
| 40 | wing tip | 80 | hole |
| 42 | pattern, rear fuselage | 82 | slots |
| 43 | notch | 84 | tabs |
| 44 | outboard surfaces, r.f. | 90 | openings |
| 46 | inboard surfaces, r.f. | 92 | wings |
| 48 | edges, rear fuselage | 94 | covering |

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. A model airplane having parts thereof such as the fuselage and wing formed of resilient, pre-stressed, sheet metal; wherein the improvement comprises: reinforcement for the wing in the form of a channel formed from the sheet metal of the wing located inside the wing.

2. The invention as defined in claim 1 wherein the channel is formed from sheet metal from the top of the wing and the bottom of the channel is attached to the inside surface of the bottom of the wing.

3. A model airplane having parts thereof such as the fuselage and wing formed of resilient, pre-stressed, sheet metal; wherein the improvement comprises: reinforcement at a joint formed by two abutting edges of sheet metal by attaching a tubular channel with two flanges inside the sheet metal part, one flange attached to the sheet metal on one side of the joint and the other flange attached to the sheet metal at the other side of the joint.

4. A model airplane having parts thereof such as the fuselage and wing formed of resilient, pre-stressed, sheet metal; wherein the improved joint of two edges of the sheet metal comprises: one of the edges of the sheet metal folded in a substantially S-shaped cross section, such that a pocket is formed which slidably receives the other edge of said sheet metal, and thermal setting glue in said pocket.

5. The invention as defined in claim 4 further comprising:

a hook on the pocket engaging a hook on the other edge.

6. The invention as defined in claim 4 further comprising:

a hook on the pocket engaging a dimple on the other edge.

* * * * *